US007175041B2

(12) United States Patent
Ekkert

(10) Patent No.: US 7,175,041 B2
(45) Date of Patent: Feb. 13, 2007

(54) CAP WITH ATTACHED UTENSIL

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 10/642,810

(22) Filed: Aug. 14, 2003

(65) Prior Publication Data

US 2005/0035122 A1 Feb. 17, 2005

(51) Int. Cl.
*B65D 51/24* (2006.01)
*B65D 41/56* (2006.01)
*A45C 11/20* (2006.01)

(52) U.S. Cl. ..... 220/212; 206/541; 206/542; 220/735

(58) Field of Classification Search ..... 220/212, 220/780, 735, 288, 212.5; 206/541, 542
See application file for complete search history.

(56) References Cited

U.S. PATENT DOCUMENTS 2,942,752 A * 6/1960 Brunel ..... 220/212
3,618,751 A * 11/1971 Rich ..... 206/219
3,624,787 A * 11/1971 Newman ..... 220/212
4,216,875 A * 8/1980 Stanish ..... 220/212
5,695,084 A * 12/1997 Chmela et al. ..... 220/212
5,705,212 A * 1/1998 Atkinson ..... 426/115
5,706,974 A * 1/1998 Murdick et al. ..... 220/735
5,775,531 A * 7/1998 Lowry ..... 220/212.5
5,992,667 A * 11/1999 Huang ..... 220/212
6,116,450 A * 9/2000 Huang ..... 220/212
6,604,645 B1 * 8/2003 Vaupotic ..... 220/212

* cited by examiner

*Primary Examiner*—Anthony D. Stashick
*Assistant Examiner*—Niki M. Eloshway
(74) *Attorney, Agent, or Firm*—Welsh & Katz, Ltd.

(57) ABSTRACT

A cap/utensil combination having a cap having a cap top with an inner surface having at least a contact area thereof that is substantially smooth, and having at least one upwardly standing sidewall attached to the cap top, sidewall having an inner surface. The inner surface of the sidewall has a rib structure. A utensil has first and second points of contact with sections of the rib structure and at least partially along an axis of symmetry of the utensil and a third point of contact at least partially within a contact plane through the axis of symmetry, the contact plane being substantially perpendicular to a plane of the inner surface of the cap top. The three-points of contact ensure that the utensil is securely held within the cap, and yet is readily removable therefrom.

10 Claims, 5 Drawing Sheets

CAP WITH ATTACHED UTENSIL

FIELD OF THE INVENTION

The present invention relates in general to containers and closure structures for such containers, and more particularly, to a cap for a container having attached thereto a utensil.

BACKGROUND

Containers, such as jars made of glass, plastic, etc., for powdered and granular materials are well known. Although these containers may have a variety of shapes, typically they are cylindrical in configuration and incorporate lids or caps that screw on or otherwise attach to the container to seal an open top of the container. When such containers are used for materials having a powder or granular consistency, such as coffee, etc., a scoop is sometimes included inside the container.

When one desires to remove a portion of the enclosed powder or granular material, the scoop must be sought and is typically buried in the enclosed powder or granular material. To find the scoop, a user is forced to be involved in a messy search process whereby the powder or granular material may be contaminated.

Containers are also known in the art that are designed to contain powder or granular materials and include cap having a lip on an interior or bottom surface of the cap for selectively attaching the scoop. The lip is resiliently deformable when an edge of the scoop is pressed against it, to thereby secure the scoop to the underside of the cap. However, this approach to securing the scoop to the cap in the prior art necessitates incorporating a structure on a bottom surface of the cap that engages the scoop.

Therefore, there is a need in the prior art for a simplified method of attaching a scoop to a cap, as well as an improved structure for holding the scoop or other utensil inside the cap, which is attached to a container.

SUMMARY

In one embodiment the cap/utensil combination has a cap having a cap top with a substantially smooth inner surface, and having at least one upwardly standing sidewall attached to the cap top. A rib is included on the inner surface of the sidewall. A utensil may have first and second points of contact at least partially along an axis of symmetry of the utensil and a third point of contact at least partially within a contact plane through the axis of symmetry. The utensil has a handle and a material section attached thereto. A first end of the handle, which is opposed from a second end of the handle attached to the material section, engages the rib at a first point of contact. The material section has a first end opposed from a second end, which is attached to the second end of the handle. The first end of the material section engages the rib at a second point of contact, which is located substantially opposite the location of engagement of the rib by the first end of the handle. A third point of contact occurs between the top open portion of the utensil and a smooth area on the inner surface of a cap top. The three-points of contact ensure that the utensil is securely held within the cap, and yet is readily removable.

In one embodiment, the utensil has a bowl, which has an opening having a top plane generally parallel to the plane of the opening of the container. In another embodiment, the bowl has an opening having a top plane that is not parallel to the plane of the opening of the container, and preferably generally perpendicular to the plane of the opening of the container.

BRIEF DESCRIPTION OF THE DRAWINGS

The features of the present invention which are believed to be novel, are set forth with particularity in the appended claims. The invention may best be understood by reference to the following description taken in conjunction with the accompanying drawings, in the several figures of which like reference numerals identify like elements, and in which:

DETAILED DESCRIPTION

Figure 1:
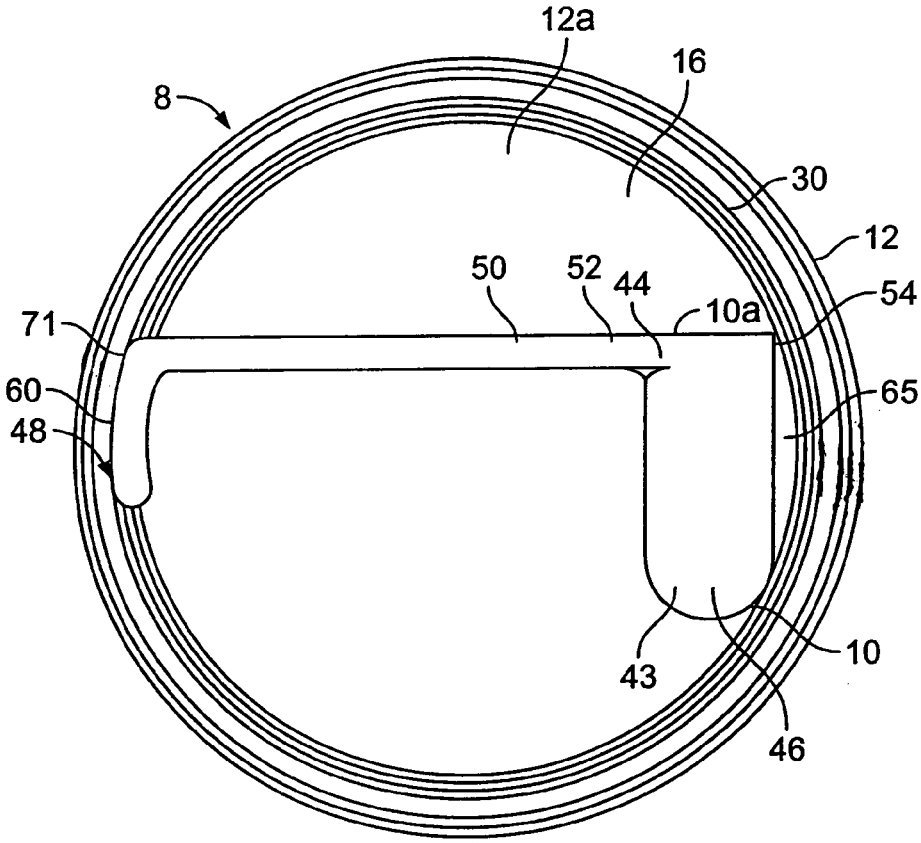
FIG. 1 is a top view of one embodiment of the cap/utensil combination.

While the present invention is susceptible of embodiments of various forms, there are shown in the drawings, and will hereinafter be described, some exemplary and non-limiting embodiments, with the understanding that the present disclosure is to be considered an exemplification of the invention. It is not intended to limit the invention to the specific embodiments illustrated.

Embodiments of the cap/utensil combination provide improvements over prior art approaches, especially in that the utensil, which may be a scoop, spoon, or other configuration, is designed to fit within the interior of the cap. The utensil may be designed and dimensioned such that the utensil may be mounted within the cap without using any structure such as posts or pins on the inner surface of the cap top. Furthermore, in some embodiments the utensil's design does not protrude past the open end of the cap when mounted inside the cap. The cap also remains in position during shipping, handling and use. Although the utensil is secured within the cap, it is easily removable and replaceable by a user. The cap may have a multi-lead thread for easy on and off of the container. The cap may also incorporate anti back-off features and other design features that are well known in the art.

FIG. 1 shows one embodiment of the cap/utensil combination 8, wherein a utensil 10 is held with a cap 12. Utensil 10, in this embodiment has an opening 10*a*; the plane of the opening 10*a* is preferably generally perpendicular to the opening 12*a* of cap 12. In this manner the bowl remains generally clean, both when the cap and container are sealed together and when the cap is apart from the container in an open position.

Figure 1A:
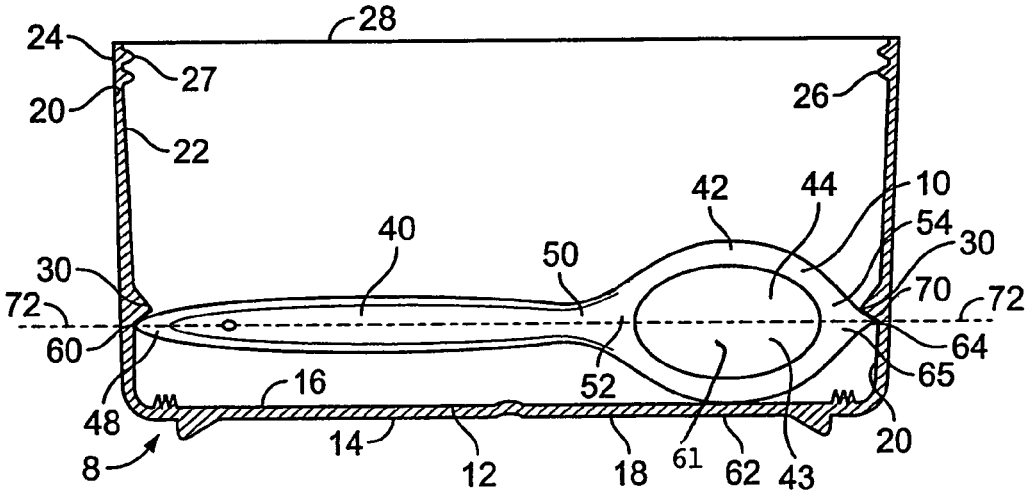
FIG. 1*a* is a cross-sectional side view of the FIG. 1 cap/utensil combination.

The cap 12 is depicted in an embodiment as being circular, for example, and being securable onto the open portion of a container not shown. It will be understood that other shapes of cap 12 are possible with different types of attachment means such as latches or clasps. FIG. 1*a* shows a cross-sectional view of the utensil 12 and cap 10. The cap 12 has a top 14, which has an inner surface 16 and an outer surface 18. Depending from the top 14 is a sidewall skirt 20. Sidewall skirt 20 has an inner surface 22 and an outer surface 24. An attachment structure 26, such as threads 27, is formed at the open end 28 on the inner surface 22 of the sidewall 20.

The cap 12 has an internal rib 30, which is located on the inner surface 22 of sidewall 20. The internal rib 30 is spaced a predetermined distance from the inner surface 16 of cap top 14. As can be seen in FIG. 1, the internal rib 30 is continuous along the entire circumference of the sidewall skirt 20. It will be understood that internal rib 30 does not need to be continuous and that it can be segmented in different areas along the inner surface 22 of sidewall skirt 20.

The utensil 10 may have a handle 40 attached to a material section 42. Material section 42 may be, for example, a scoop 43 having a top end 44 and a closed bottom end 46. The handle 40 as shown in FIG. 1, has a first end 48 and a second end 50. The material section 42 has a first end 52 and a second end 54, which is attached or otherwise connected to the second end 50 of the handle 40.

The first end 48 of the handle 40 can be flared as depicted in FIG. 1 and can snap or otherwise be held under the internal rib 30 on the inner surface 22 of the sidewall skirt 20 as shown in FIG. 1*a*. Similarly material section 42 has a second end 54, which is held under the rib 30. It will be understood that the handle 40 can be made such that it can express a degree of flexibility so that utensil 10 can be easily removed from cap 12 when desired but held fast within cap 12 as necessary.

It will be seen in FIGS. 1 and 1A that first end 48 of handle 40 forms a first point of contact 60 between the utensil 10 and cap 12. A portion 61 of material section 42 forms a second point of contact 62 between the utensil 10 and the cap 12. A third point of contact 64 is formed between the sidewall 65 of the material section 42 and an area 70 on the inner surface 22 of the sidewall skirt 20. The area 70 can be substantially flat. It will be understood that the term "point of contact" need not be limited to one specific point. The contact may occur for a length along a surface, such as the portion 71 of the first end 48 of handle 40 contacts the inner surface 22 of the sidewall skirt 20 for a length along the sidewall skirt 20.

Figure 2:
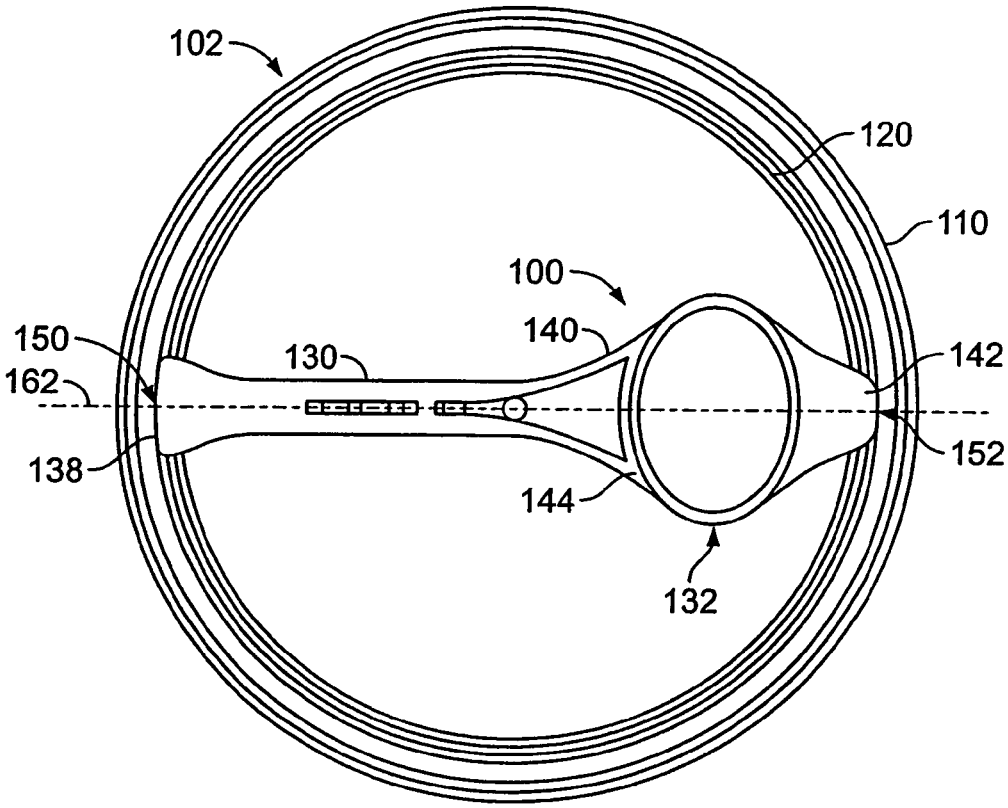
FIG. 2 is a top view of another embodiment of the cap/utensil combination.

FIG. 2 shows one embodiment of the cap/utensil combination wherein a utensil 100 is held within a cap 102. The cap 102 is depicted in one embodiment as being circular, for example, and being screwable onto the open portion of a container. Other shapes of the cap 102 are possible with different types of attachments means to the container. The FIG. 2 utensil 100 and cap 102 are also shown in a cross-sectional view in FIG. 3. The cap 102 has a cap top 104, which has an inner surface 106 and an outer surface 108. Upstanding from the cap top 104 is a sidewall 110. The sidewall 110 has an inner surface 112 and an outer surface 114. An attachment structure 116, such as threads, is formed at the open end 118 on the inner surface 112 of the sidewall 110.

The cap 102 also has an internal rib 120, which is located on the inner surface 112 of the sidewall 110. The internal rib 120 is spaced a pre-determined distance from the inner surface 106 of the cap top 104. As can be seen in FIG. 2 the internal rib 120 is continuous along the entire circumference of the sidewall 110. It is to be appreciated that the internal rib 120 need not be continuous and may be segmented in different areas along the inner surface 112 of the sidewall 110.

The utensil 100 may have a handle 130 attached to a material section 132. The material section 132 may be, for example, a scoop having a top open end 134 and a closed bottom end 136. The handle 130 has a first end 138 and a second end 140. The material section 132 has a first end 142 and a second end 144, which is attached or otherwise connected to the second end 140 of the handle 130.

Figure 3:
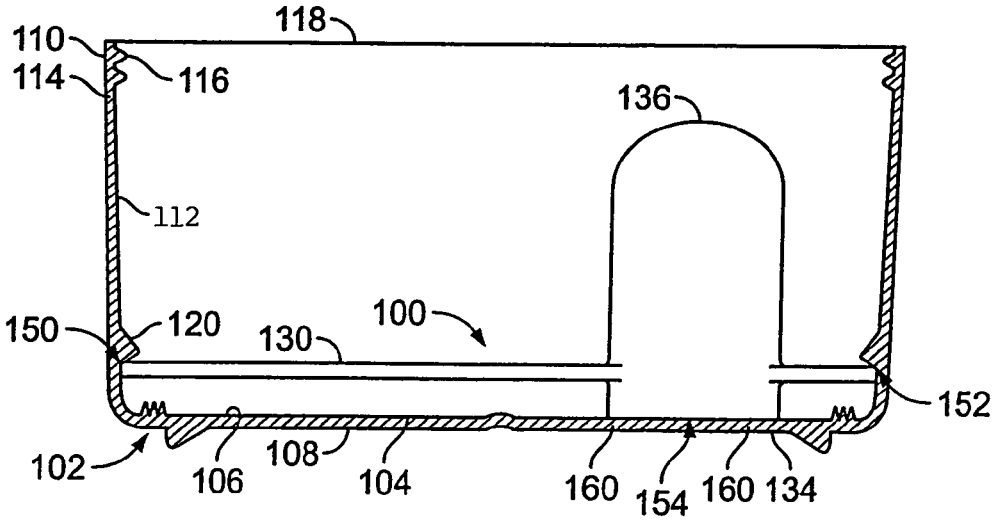
FIG. 3 is a cross-sectional side view of the FIG. 2 cap/utensil combination.

The first end 138 of the handle 130 may be flared as depicted in FIG. 2 and may snap or otherwise be held under the internal rib 120 on the inner surface 112 of the sidewall 110 as shown in FIG. 3. Similarly the material section 132 has a first end 142, which is held under the rib 120. It is to be appreciated that the handle 130 may be flexible such that the utensil 100 can be removed from the cap 102.

The first end 138 of the handle 130 forms a first point of contact 150 between the utensil 100 and the cap 102. The first end 142 of the material section 132 forms a second point of contact 152 between the utensil 100 and the cap 102. A third point of contact 154 is formed between the first opened end 134 of the material section 132 and an area 160 on the inner surface 106 of the cap top 104. The area 160 may be substantially flat. It is to be understood that the term "point of contact" may refer to a location, such as the portion of the first end 138 of the handle 130 that contacts the inner wall 112 of the side wall 110 or a portion or all of the first end 134 of the material section 132 of the utensil 100 that contacts the area 160 on the inner surface 106 of the cap top 104.

At least portions of the first and second points of contact 150,152 lie along an axis of symmetry 162 of the utensil 100. A plane extending through the axis of symmetry 162 includes at least a portion of the third point of contact 154. At least portions of the three points of contact therefore lie in a contact plane that is perpendicular to a plane of the cap top.

Figure 4:
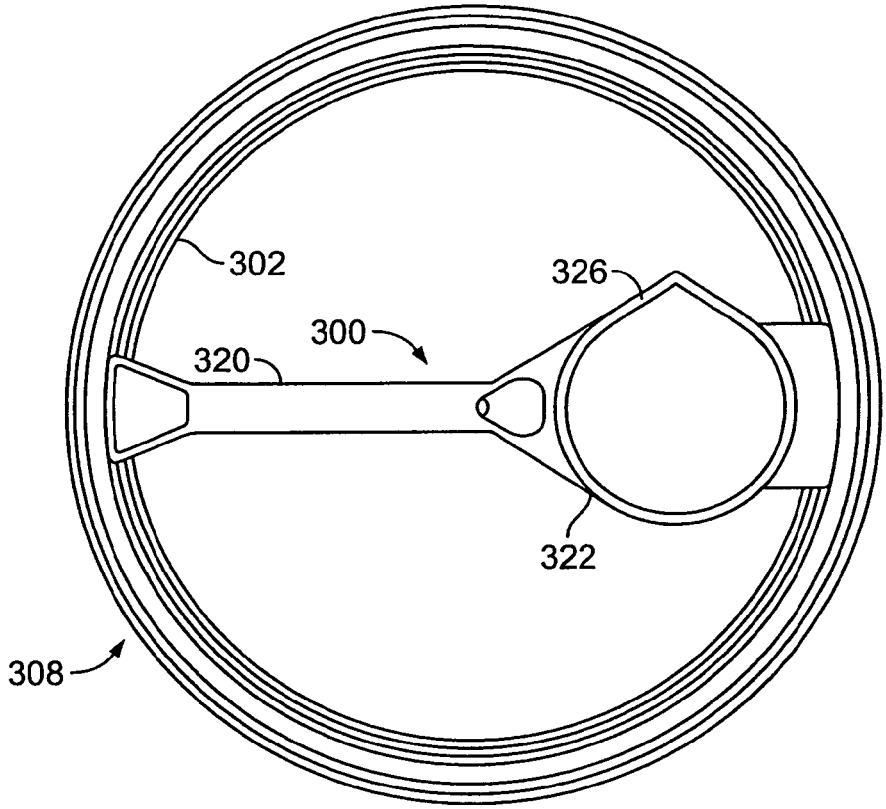
FIG. 4 is a top view of another embodiment of the cap/utensil combination.
Figure 5:
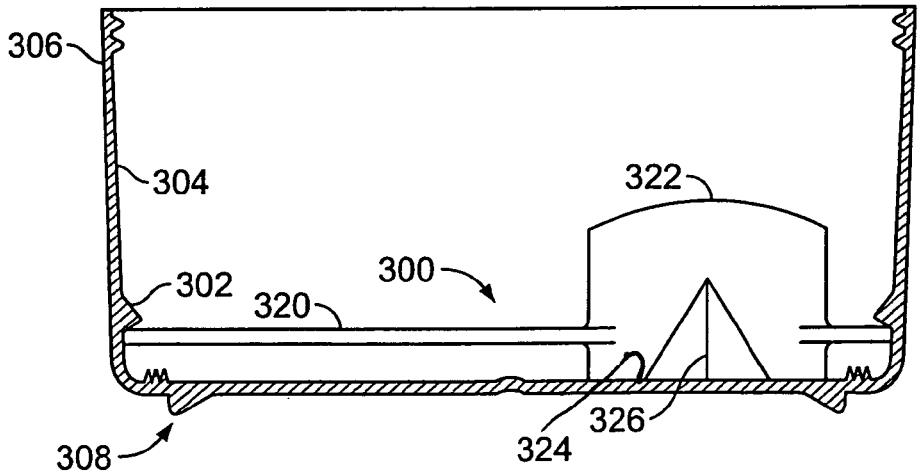
FIG. 5 is a cross-sectional side view of the FIG. 3 cap/utensil combination.

FIG. 4 depicts another embodiment of the cap/utensil combination wherein the utensil 300 is attached under a rib 302 on an inner surface 304 of a sidewall 306 of a cap 308. The utensil 300 has a handle 320 and a material section 322, which has an open top 324 (see FIG. 5). The material section 322 in this embodiment also has a pour spout 326.

Figure 6:
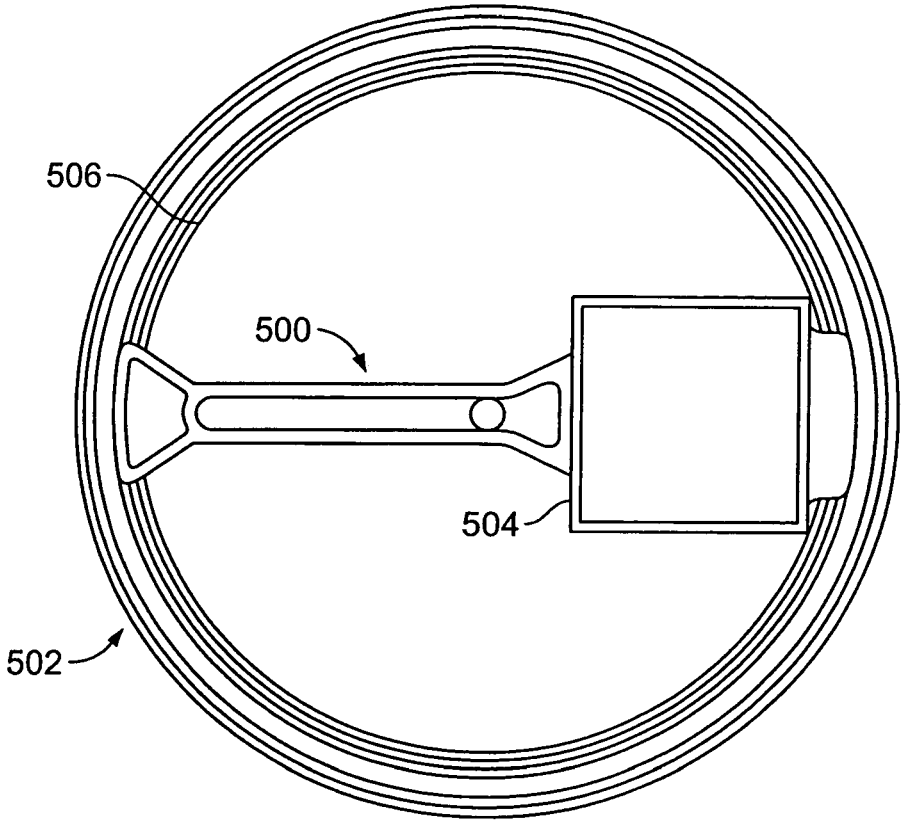
FIG. 6 is a top view of yet another embodiment of the cap/utensil combination.
Figure 7:
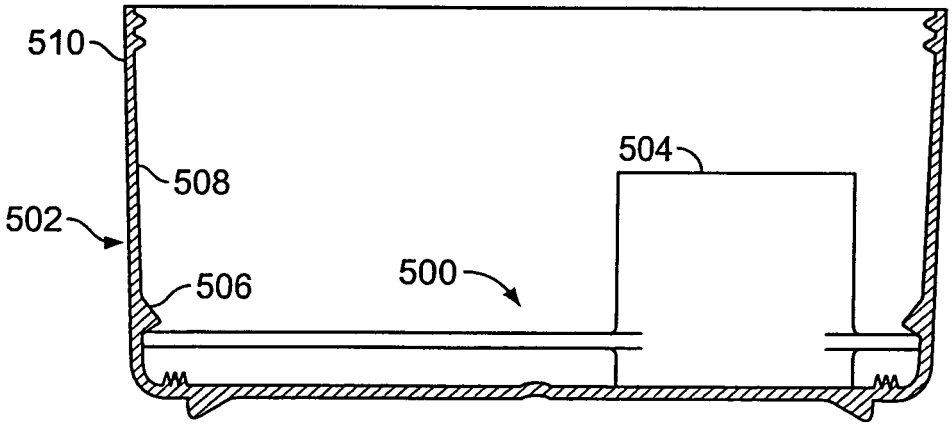
FIG. 7 is a cross-sectional side view of the FIG. 5 cap/utensil combination.

FIG. 6 depicts a further embodiment of the cap/utensil combination having a utensil 500, which is removably attached to a cap 502. In this embodiment the utensil 500 has a material section 504 that is substantially square or rectangular in shape. The utensil 500 is removably secured beneath a rib 506 on an inner surface 508 of a sidewall 510 of the cap 502 (see FIG. 7).

Figure 8:
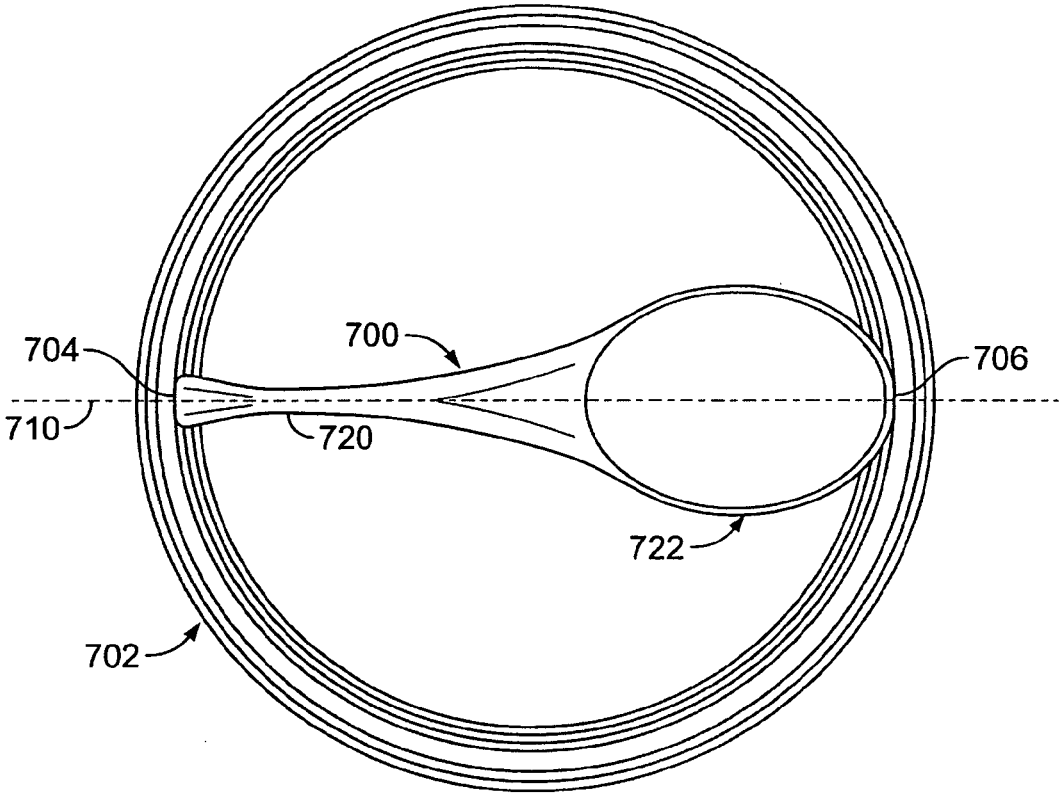
FIG. 8 is a top view of a further embodiment of the cap/utensil combination.
Figure 9:
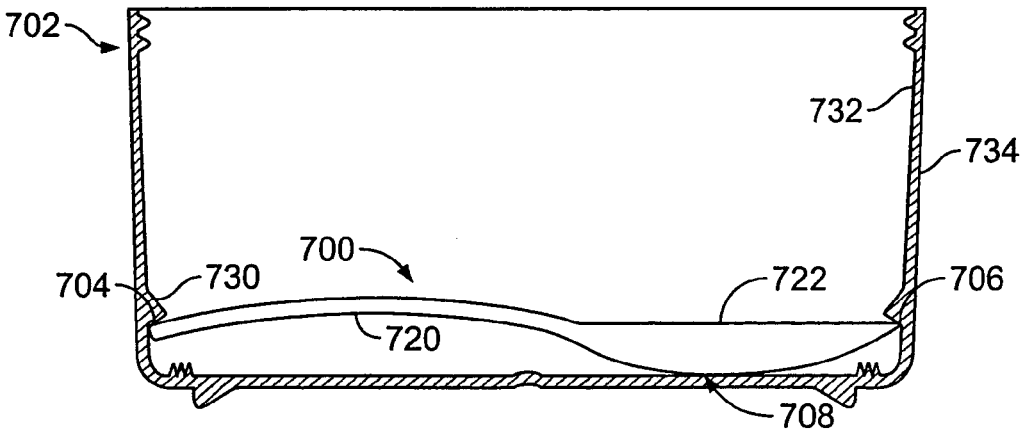
FIG. 9 is a cross-sectional side view of the FIG. 8 cap/utensil combination.

FIG. 8 depicts yet another embodiment of the cap/utensil combination in which a utensil 700 is removably attached to a cap 702. The utensil 700 is attached to the cap 702 at three points of contact 704, 706 and 708 (see FIG. 9). The utensil 700, such as a spoon, has an axis of symmetry 710 and the three points of contact 704, 706 and 708 lie in a plane that passes through the axis of symmetry 710 along which lie the contact points 704 and 706. The utensil 700 has a handle portion 720 and a material section 722. The utensil 700 is removably secured beneath a rib 730 on an inner surface 732 of a sidewall 734 of the cap 702.

The utensils, as well as the caps, in the various embodiments of the cap/utensil systems described above may be formed from a variety of materials, such as plastic, metal, etc. and may have a variety of different configurations and shapes. Also, the utensil may have different cross-sectional configurations for the material section of the utensil. The handle of the utensil may have numerous different configurations. Furthermore, the handle may be attached to the material section of the utensil at different spaced locations between the opened first end or top of the utensil and the closed bottom end of the utensil.

The present invention is not limited to the particular details of the apparatus depicted and other applications are contemplated. Certain other changes may be made in the above-described apparatus without departing from the true spirit and scope of the invention, herein involved. It is intended, therefore, that the subject matter in the above depiction shall be interpreted as illustrative and not in a limiting sense.

What is claimed is:

1. A cap and utensil assembly, comprising:

a cap having a cap top with an inner surface having at least a contact area, and having at least one upwardly standing sidewall adjacent to the cap top, said sidewall having an inner surface;

a rib structure on the inner surface of the sidewall defining a first plane; and a one-piece rigid utensil comprising a cup portion and a handle, the cup portion having an enclosed volume and a depth greater than its width, the cup portion having a curved sidewall integral its distal end, the handle being substantially thinner than the width of the cup portion and having a first portion and a second portion substantially perpendicular to the first portion with a curved distal end, the utensil having points of contact consisting essentially of a first point being a line contact between the curved sidewall of the cup portion and the rib structure, a second point being a line contact between the curved distal end of the handle and the rib structure and a third point of contact between the cup portion and the contact area of the cap top at least partially within a second plane perpendicular to the cap top, the second plane being different from the first plane of the rib;

wherein the three-points of contact ensure that the utensil is securely held within the cap, and yet is readily removable therefrom.

2. The cap and utensil assembly according to claim 1, wherein the rib structure is a continuous rib on the inner surface of the sidewall.

3. The cap and utensil assembly according to claim 2, wherein the rib structure is spaced a predetermined distance from the inner surface of the cap top.

4. The cap and utensil assembly according to claim 1, wherein the cup portion has an opening in a plane perpendicular to the cap top.

5. The cap and utensil assembly according to claim 1 wherein the line contact between the curved sidewall of the cup portion and the rib structure is substantially longer than line contact between the curved distal end of the handle and the rib structure.

6. The cap and utensil assembly according to claim 5, wherein the line contact between the curved sidewall of the cup portion and the rib structure extends along the entire depth of the cup portion and the line contact between the curved distal end of the handle and the rib structure extends along the entire length of the curved distal end.

7. The cap and utensil assembly according to claim 1, wherein the inner surface of the cap top is substantially flat with no extensions.

8. The cap and utensil assembly according to claim 1, wherein the cup portion of the utensil has a substantially oval cross-sectional configuration.

9. The cap and utensil assembly according to claim 1, wherein the cup portion of the utensil has a substantially square cross-sectional configuration.

10. The cap and utensil assembly according to claim 1, wherein the cup portion of the utensil has a spout.

* * * * *